US007658081B2

(12) United States Patent
Kanai et al.

(10) Patent No.: US 7,658,081 B2
(45) Date of Patent: Feb. 9, 2010

(54) STRUCTURE FOR SENSING REFRIGERANT FLOW RATE IN A COMPRESSOR

(75) Inventors: Akinobu Kanai, Kariya (JP); Hiroyuki Nakaima, Kariya (JP); Yoshinori Inoue, Kariya (JP); Atsuhiro Suzuki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 336 days.

(21) Appl. No.: 11/978,036

(22) Filed: Oct. 26, 2007

(65) Prior Publication Data

US 2008/0104984 A1 May 8, 2008

(30) Foreign Application Priority Data

Oct. 27, 2006 (JP) ..... 2006-292493

(51) Int. Cl.
*F25B 49/00* (2006.01)

(52) U.S. Cl. ..... 62/228.3; 62/192; 62/470; 73/861.57; 417/43

(58) Field of Classification Search ..... 62/228.3, 62/228.5, 192, 470; 73/861.57; 417/43, 417/222, 2, 213, 269, 222.1
See application file for complete search history.

(56) References Cited

U.S. PATENT DOCUMENTS 4,646,624 A * 3/1987 Stearns ..... 92/37
5,284,053 A * 2/1994 Wadlow et al. ..... 73/199
6,263,687 B1 * 7/2001 Ban et al. ..... 62/228.3
6,425,254 B1 * 7/2002 Ota et al. ..... 62/133
7,204,098 B2 * 4/2007 Yamada et al. ..... 62/470
7,523,620 B2 * 4/2009 Umemura et al. ..... 62/228.3
2004/0221610 A1 * 11/2004 Yamada et al. ..... 62/470
2008/0110188 A1 * 5/2008 Inoue et al. ..... 62/228.3

FOREIGN PATENT DOCUMENTS

JP 62-56820 3/1987
JP 09-257534 10/1997
JP 2004-12394 1/2004
JP 2004-197679 7/2004
JP 2004-218610 8/2004

* cited by examiner

*Primary Examiner*—George Nguyen
(74) *Attorney, Agent, or Firm*—Locke Lord Bissell & Liddell LLP

(57) ABSTRACT

The compressor has a differential pressure type flow rate detector that obtains the pressure in an upstream passage and the pressure in a downstream passage to detect a refrigerant flow rate within a refrigerant passage. The detector has an accommodation chamber, and a partition body slidably accommodated within the accommodation chamber. The partition body comparts the accommodation chamber into a high pressure chamber to which the pressure in the upstream passage is introduced, and a low pressure chamber to which the pressure in the downstream passage is introduced. The compressor has an oil separator having an oil introduction passage connected to the oil separating chamber and a high pressure introduction passage introducing the pressure in the upstream passage to the high pressure chamber. The oil introduction passage introduces the oil separated from the refrigerant by the oil separator to a pressure zone other than a discharge pressure zone.

7 Claims, 6 Drawing Sheets

R
41
40
412
42
44
58
13
39
413
46
45
53
40
2B
2B
412
132
6
5
4
41
63
411
42
44
17
16
14
15
291
33
47
43
59
58
52
30
350
340
36
301
49
48
64
481
50
501
29 (11)
33
31
110
4
6
5
12
38
351
35
341
342
34
37
60

STRUCTURE FOR SENSING REFRIGERANT FLOW RATE IN A COMPRESSOR

FIELD OF THE INVENTION

The present invention relates to a structure for sensing a flow rate of refrigerant in a compressor.

BACKGROUND OF THE INVENTION

Among variable displacement compressors as disclosed in Japanese Laid-Open Patent Publication No. 2004-197679, there is a type having a displacement control valve the opening degree of which is controlled by detecting whether a refrigerant flow rate flowing through a passage provided within the compressor is proper. The opening degree of the displacement control valve is changed on the basis of a differential pressure between both sides of a restriction in a passage for the refrigerant in the compressor. In this displacement control valve, a force based on the differential pressure acts against an electromagnetic force generated by a current application to a solenoid within the displacement control valve via a valve body, and the opening degree of the valve is determined by arranging the valve body at a position where these two opposing forces are balanced.

The more the refrigerant flow rate increases, the higher the differential pressure between both sides of the restriction becomes. The differential pressure reflects the refrigerant flow rate, and the opening degree of the displacement control valve is increased when the differential pressure is increased. If the refrigerant flow rate becomes more than a proper flow rate, the opening degree of the displacement control valve is increased, and the amount of the refrigerant supplied to a crank chamber from a discharge chamber via a valve hole is increased. Accordingly, the pressure in the crank chamber is increased, the inclination angle of a swash plate is decreased, and the refrigerant flow rate is decreased to be converged into the proper flow rate. If the refrigerant flow rate becomes smaller than the proper flow rate, the opening degree becomes small, and the amount of the refrigerant supplied to the crank chamber from the discharge chamber via the valve hole is decreased. Accordingly, the pressure in the crank chamber is decreased, the inclination angle of the swash plate is increased, and the refrigerant flow rate is increased to be converged into the proper flow rate.

In the case that the compressor obtains a driving force from a vehicle engine, it is necessary to execute an output control of the engine to achieve an output capable of providing a necessary torque for driving the compressor. Since the refrigerant flow rate reflects the torque of the compressor, the torque of the compressor can be estimated by detecting the refrigerant flow rate. Although the differential pressure between both sides of the restriction reflects the refrigerant flow rate, the refrigerant flow rate is not actually detected. Accordingly, an estimation of the refrigerant flow rate (that is, the torque of the compressor) is executed on the basis of a magnitude of an electric current supplied to the solenoid of the displacement control valve.

At a time of starting the compressor, an operation control for setting the displacement to 100% is executed. However, since a liquid refrigerant in the crank chamber reserved during a stop of the operation of the compressor is vaporized with the start of the compressor, the pressure in the crank chamber becomes high, and the compressor maintains the operation while keeping the inclination angle of the swash plate small. A state in which the inclination angle of the swash plate is small corresponds to a state in which the torque of the compressor is small, that is, a state in which the refrigerant flow rate is small. On the other hand, the refrigerant flow rate estimated from the electric current supplied to the solenoid is large. Accordingly, even though the torque of the compressor is actually small, the operation of the vehicle engine is controlled on the assumption that the torque of the compressor is large. This causes an energy loss.

Accordingly, it is desirable to detect the refrigerant flow rate flowing within the variable displacement compressor by using a differential pressure type flow rate detector, for example, disclosed in Japanese Laid-Open Patent Publication Nos. 62-56820, 9-257534, and 2004-12394. When applying the flow rate detector to the compressor, the flow rate detector outputs an electric signal in correspondence to the differential pressure between both sides of the restriction provided within the passage for the refrigerant formed within the compressor.

Japanese Laid-Open Patent Publication No. 2004-12394 discloses a differential pressure type flow rate detector in which a first differential pressure chamber and a second differential pressure chamber are separated by a spool (a slidable partition body). In this detector, a high-pressure fluid is introduced to the first differential pressure chamber, and a low-pressure fluid is introduced to the second differential pressure chamber. The force based on the differential pressure between the pressure in the first differential pressure chamber and the pressure in the second differential pressure chamber acts against a spring force of a spring urging the spool toward the first differential pressure chamber from the second differential pressure chamber. A detection body coupled to the spool is arranged at a position at which the differential pressure and the spring force are balanced, and the electric signal according to the detection body is output.

In the flow rate detector disclosed in Japanese Laid-Open Patent Publication No. 2004-12394, the differential pressure between the pressure in the first differential pressure chamber and the pressure in the second differential pressure chamber is generated by a pipe orifice provided in the middle of the passage connecting the first differential pressure chamber and the second differential pressure chamber. However, the installation of the pipe orifice causes an increase of a flow resistance of the refrigerant, and is not preferable. Further, since the spool (the partition body) comes into slidable contact with a peripheral wall surface of the spool chamber, the sliding parts wear.

SUMMARY OF THE INVENTION

Accordingly, it is an objective of the present invention to provide a refrigerant flow rate detecting structure which does not increase a flow resistance and suppresses an abrasion in slidably contacting parts between a partition body and a wall surface of an accommodation chamber accommodating the partition body.

One aspect of the present invention is a structure for sensing flow rate of refrigerant in a compressor. The compressor includes a refrigerant passage, a differential pressure type flow rate detector, a discharge pressure zone, an oil separator, an oil introduction passage, and a high pressure introduction passage. The refrigerant passes through the refrigerant passage. The passage is comparted into an upstream passage having a high pressure and a downstream passage having a low pressure. The differential pressure type flow rate detector obtains the pressure in the upstream passage and the pressure in the downstream passage to detect a refrigerant flow rate within the refrigerant passage. The detector is provided with an accommodation chamber, a partition body slidably accommodated within the accommodation chamber, a first pressure chamber, and a second pressure chamber. The first and second pressure chambers are separated from each other by the partition body. The pressure in the upstream passage is transmitted to the first pressure chamber. The pressure in the downstream passage is transmitted to the second pressure chamber. The compressed refrigerant gas is discharged into the discharge pressure zone. The oil separator has an oil separating chamber separating the oil from the refrigerant within the upstream passage. The oil separator comparts the refrigerant passage into the upstream passage and the downstream passage. The oil introduction passage is connected to the oil separating chamber. The oil introduction passage introduces the oil separated from the refrigerant by the oil separator to a pressure zone other than the discharge pressure zone. The high pressure introduction passage introduces the pressure in the upstream passage to the first pressure chamber via the oil introduction passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A description will be given of a first embodiment obtained by embodying the present invention with reference to FIGS. 1 to 6.

Figure 1:
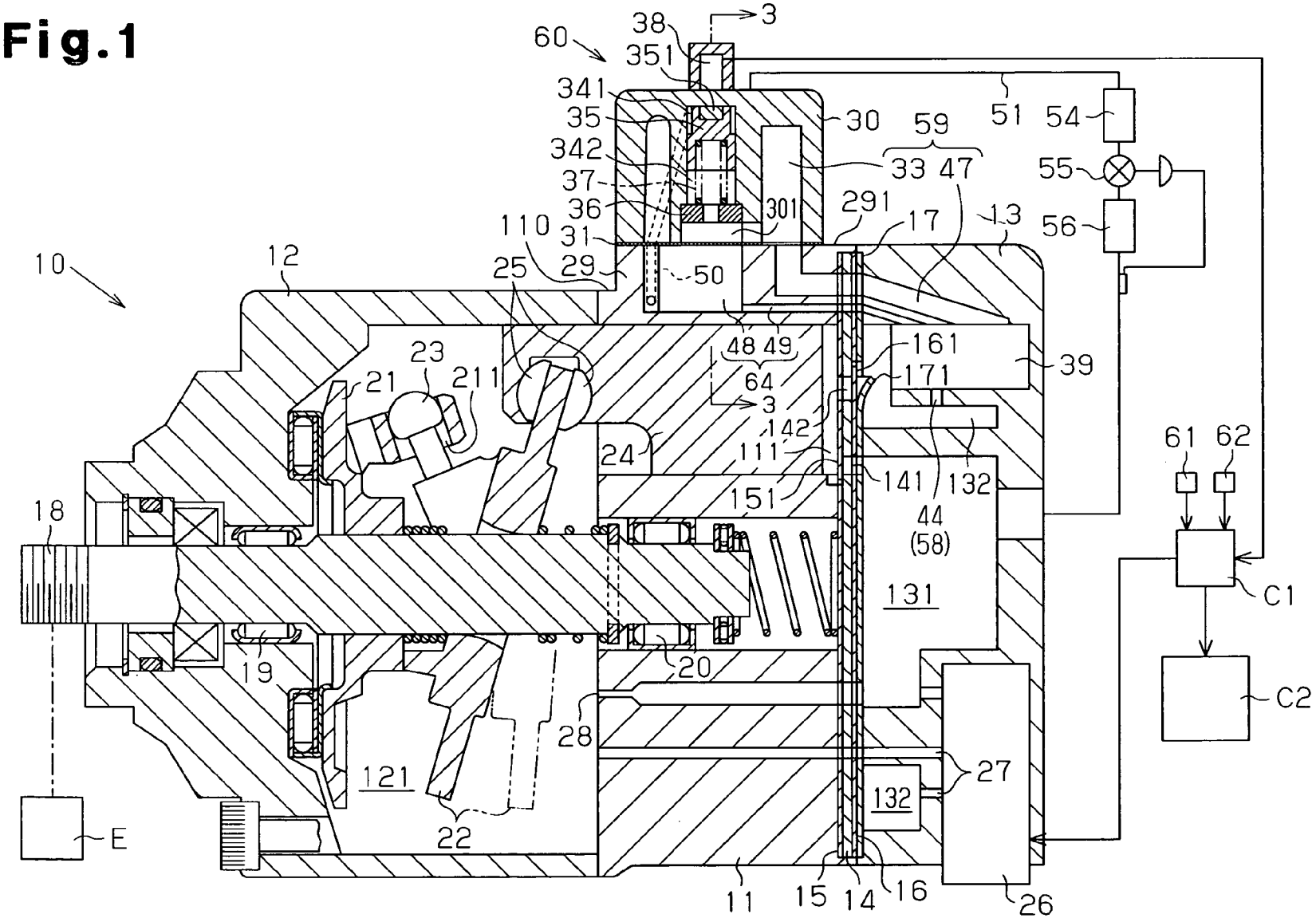
FIG. 1 is a cross-sectional side view of a whole of a variable displacement compressor in accordance with a first embodiment of the present invention.

As shown in FIG. 1, a housing of a variable displacement compressor 10 is provided with a cylinder block 11, a front housing member 12 connected to a front end of the cylinder block 11, and a rear housing member 13 connected to a rear end of the cylinder block 11 via a valve plate 14, valve forming plates 15 and 16, and a retainer forming plate 17. The cylinder block 11, the front housing member 12 and the rear housing member 13 structure the whole housing of the compressor 10.

The front housing member 12 and the cylinder block 11 form a control pressure chamber 121. A rotary shaft 18 is rotatably supported to the front housing member 12 and the cylinder block 11 respectively via radial bearings 19 and 20. The rotary shaft 18 protrudes to the outside from the control pressure chamber 121, and obtains a driving force from a vehicle engine E serving as an external driving source.

A rotary support 21 is fixed to the rotary shaft 18, and a swash plate 22 is supported thereto so as to be slidable and tiltable in an axial direction. A guide pin 23 provided in the swash plate 22 is slidably fitted to a guide hole 211 formed in the rotary support 21. The swash plate 22 is movable in the axial direction of the rotary shaft 18 while being tilted and is integrally rotatable with the rotary shaft 18, on the basis of the link between the guide hole 211 and the guide pin 23. The tilting motion of the swash plate 22 is generated by a sliding motion of the guide pin 23 with respect to the guide hole 211 and a sliding motion of the swash plate 22 with respect to the rotary shaft 18.

If a radial center of the swash plate 22 is moved toward the rotary support 21, the inclination angle of the swash plate 22 is increased. The maximum inclination angle of the swash plate 22 is regulated by contact between the rotary support 21 and the swash plate 22. The swash plate 22 shown by a solid line in FIG. 1 is under a state of the maximum inclination angle, and the swash plate 22 shown by a chain line is under a state of the minimum inclination angle.

A piston 24 is accommodated within each of a plurality of cylinder bores 111 formed through the cylinder block 11. Rotation of the swash plate 22 is converted into reciprocation of the pistons 24 by means of shoes 25, and the pistons 24 reciprocate within the cylinder bores 111.

A suction chamber 131 and a discharge chamber 132 are defined within the rear housing member 13. The suction chamber 131 corresponds to a suction pressure zone, and the discharge chamber 132 corresponds to a discharge pressure zone. Suction ports 141 are formed in the valve plate 14, the valve forming plate 16, and the retainer forming plate 17 in such a manner as to correspond to the respective cylinder bores 111. Discharge ports 142 are formed in the valve plate 14 and the valve forming plate 15 in such a manner as to correspond to the respective cylinder bores 111. Suction valve flaps 151 are formed in the valve forming plate 15 in such a manner as to correspond to the respective suction ports 141, and discharge valve flaps 161 are formed in the valve forming plate 16 in such a manner as to correspond to the respective discharge ports 142. Refrigerant within the suction chamber 131 pushes each suction valve flap 151 through the corresponding suction port 141 by a movement from the top dead center toward the bottom dead center of the associated piston 24 (the movement from right to left in FIG. 1), and flows into the cylinder bore 111. The refrigerant gas flowing into the cylinder bore 111 pushes each discharge valve flap 161 through the corresponding discharge port 142 by a movement from the bottom dead center toward the top dead center of the associated piston 24 (the movement from left to right in FIG. 1), and is discharged to the discharge chamber 132. The opening degree of each discharge valve flap 161 is regulated by contact of the discharge valve flap 161 with a retainer 171 on the retainer forming plate 17.

An electromagnetic type displacement control valve 26 is assembled in the rear housing member 13. The displacement control valve 26 is provided on a supply passage 27 connecting the discharge chamber 132 and the control pressure chamber 121. The opening degree of the displacement control valve 26 is adjusted in correspondence to the pressure of the suction chamber 131 and a duty ratio of a current applied to an electromagnetic solenoid (not shown) of the displacement control valve 26. When a valve hole of the displacement control valve 26 is closed, the refrigerant within the discharge chamber 132 is not fed to the control pressure chamber 121.

The control pressure chamber 121 is connected to the suction chamber 131 via a discharge passage 28, and the refrigerant within the control pressure chamber 121 flows out to the suction chamber 131 via the discharge passage 28. If the opening degree of the displacement control valve 26 becomes large, the amount of the refrigerant flowing into the control pressure chamber 121 from the discharge chamber 132 via the supply passage 27 is increased, and the pressure in the control pressure chamber 121 is increased. Accordingly, the inclination angle of the swash plate 22 is decreased, and the displacement of the compressor is decreased. If the opening degree of the displacement control valve 26 becomes small, the amount of the refrigerant flowing into the control pressure chamber 121 from the discharge chamber 132 via the supply passage 27 is decreased, and the pressure in the control pressure chamber 121 is decreased. Accordingly, the inclination angle of the swash plate 22 is increased, and the displacement of the compressor is increased.

Figures 2A, 2B:
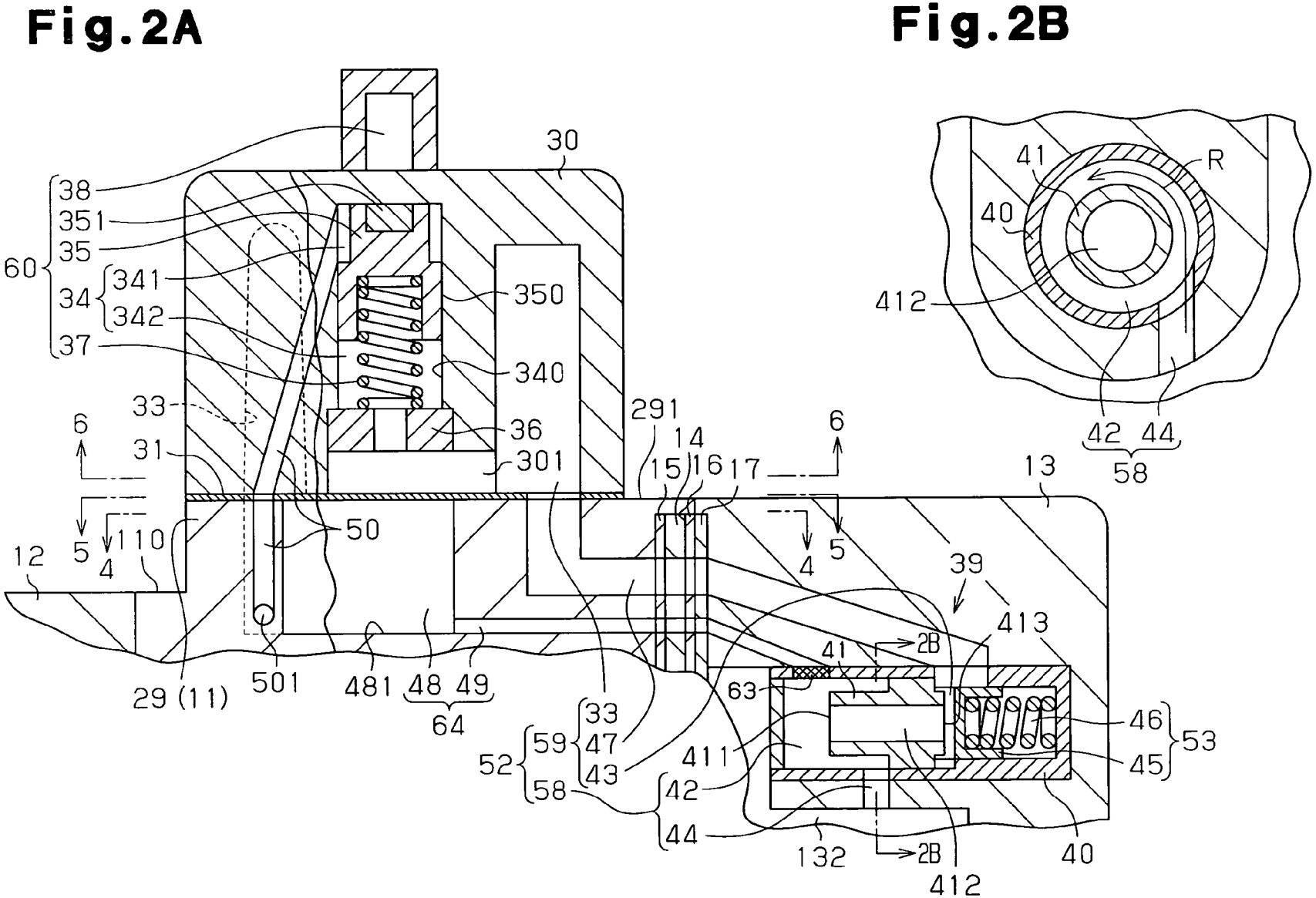
FIG. 2A is a partially enlarged cross-sectional side view of the compressor in FIG. 1.
FIG. 2B is a cross-sectional view taken along line 2B-2B in FIG. 2A.
Figure 3:
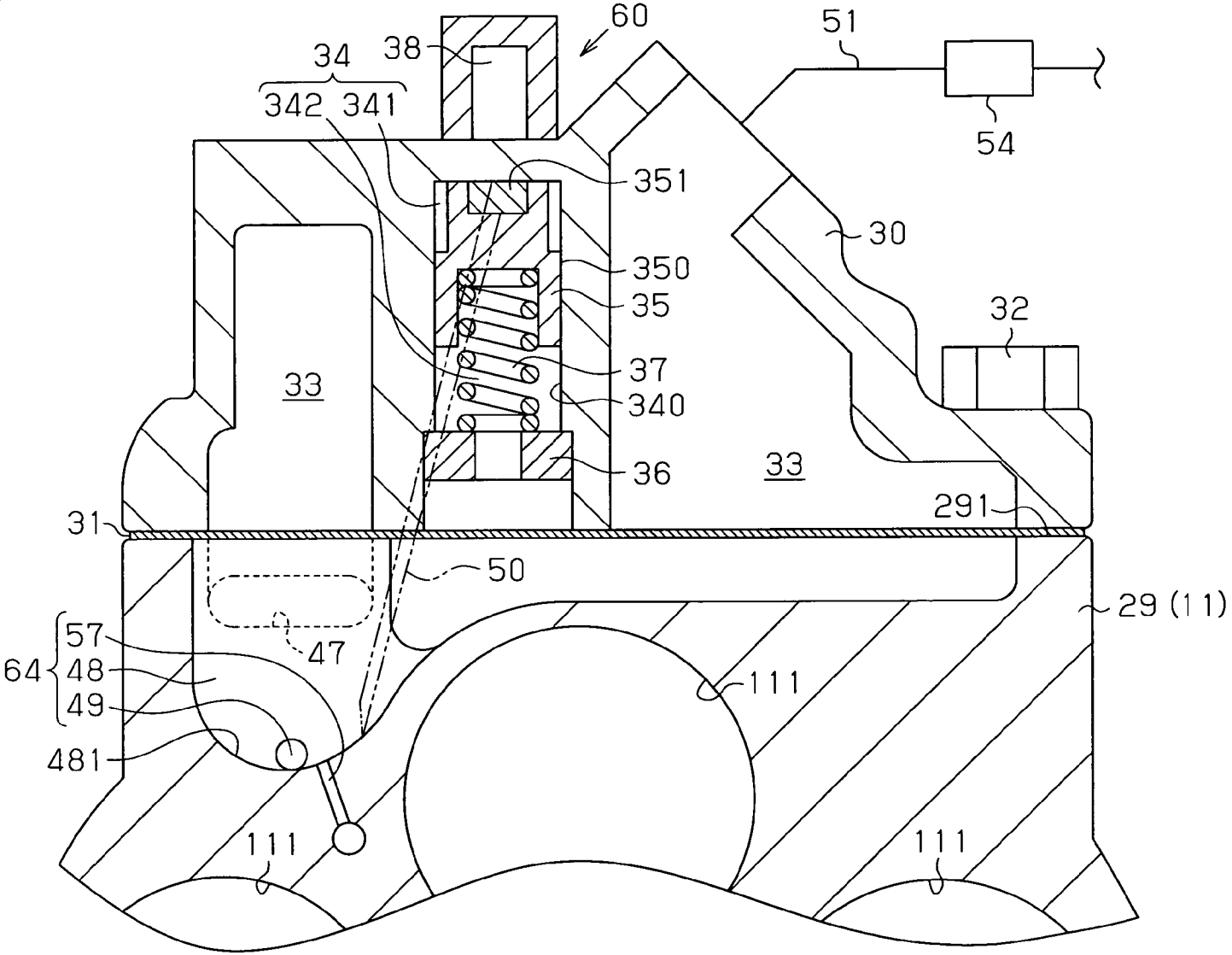
FIG. 3 is a cross-sectional view taken along line 3-3 in FIG. 1.

A protruding pedestal 29 is integrally formed in an upper portion of an outer circumferential surface 110 of the cylinder block 11. As shown in FIG. 2A, an upper end 291 of the pedestal 29, that is, an outer surface of the cylinder block 11 is flat, and a muffler forming member 30 serving as a passage forming member is coupled to the upper end 291 of the pedestal 29 with a tabular sealing gasket 31. The gasket 31 prevents refrigerant leakage from a portion between the pedestal 29 and the muffler forming member 30. As shown in FIG. 3, the muffler forming member 30 and the gasket 31 are both fixed to the pedestal 29 by a screw 32.

As shown in FIG. 2A, a muffler chamber 33 and an accommodation chamber 34 are formed in the muffler forming member 30, and a partition body 35 is accommodated in the accommodation chamber 34 so as to be slidable within the accommodation chamber 34. A horizontal cross sectional shape of the accommodation chamber 34 is a circular shape, and a circumferential surface 350 of the partition body 35 comes into slidable contact with a peripheral wall surface 340 having a circular circumferential surface shape in the accommodation chamber 34. The partition body 35 comparts the accommodation chamber 34 into a high pressure chamber 341 and a low pressure chamber 342. A compression spring 37 is arranged between the partition body 35 and a ring-shaped spring seat 36. The compression spring 37 urges the partition body 35 from the low pressure chamber 342 toward the high pressure chamber 341. The low pressure chamber 342 is connected to the muffler chamber 33 via a low pressure introduction passage 301 formed in the muffler forming member 30. The pressure in the muffler chamber 33 is applied to the low pressure chamber 342.

A permanent magnet 351 is fixed to the partition body 35, and a magnetic detector 38 is provided on an outer surface of the muffler forming member 30. The magnetic detector 38 detects a magnetic flux density of the permanent magnet 351. Information about the magnetic flux density detected by the magnetic detector 38 is transmitted to a displacement control computer C1 shown in FIG. 1.

As shown in FIG. 2A, an oil separator 39 that incorporates a check valve 53 is installed in the rear housing member 13. The oil separator 39 is provided with a housing 40. A refrigerant swirling cylinder 41 is fitted into the housing 40 and fixed inside the housing 40. The cylinder 41 comparts the housing 40 into an oil separating chamber 42 and a valve accommodation chamber 43, and the oil separating chamber 42 is connected to the discharge chamber 132 via an introduction passage 44. The refrigerant within the discharge chamber 132 flows into the oil separating chamber 42 via the introduction passage 44. The refrigerant flowing into the oil separating chamber 42 from the introduction passage 44 is swirled along an outer circumferential surface of the cylinder 41 as shown by an arrow R in FIG. 2B. The refrigerant swirling around the cylinder 41 flows into an internal space 412 of the cylinder 41 from a first opening (an inlet) 411 of the cylinder 41 open to the oil separating chamber 42. The cylinder 41 has a second opening 413 (an outlet) in an opposite side of the first opening 411.

As shown in FIG. 2A, a valve body 45 is accommodated within the housing 40. The valve body 45 opposes to the second opening 413 of the cylinder 41, and opens and closes the second opening 413. The valve body 45 is urged toward a position closing the second opening 413 by a compression spring 46. If the pressure of the refrigerant within the internal space 412 of the cylinder 41 overcomes a spring force of the compression spring 46, the refrigerant within the internal space 412 pushes back the valve body 45 to flow into the valve accommodation chamber 43. The valve body 45 and the compression spring 46 construct a check valve 53.

Figure 5:
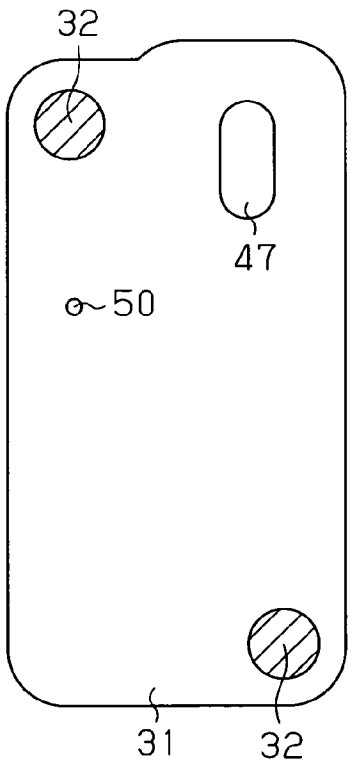
FIG. 5 is a cross-sectional view taken along line 5-5 in FIG. 2A.
Figure 4:
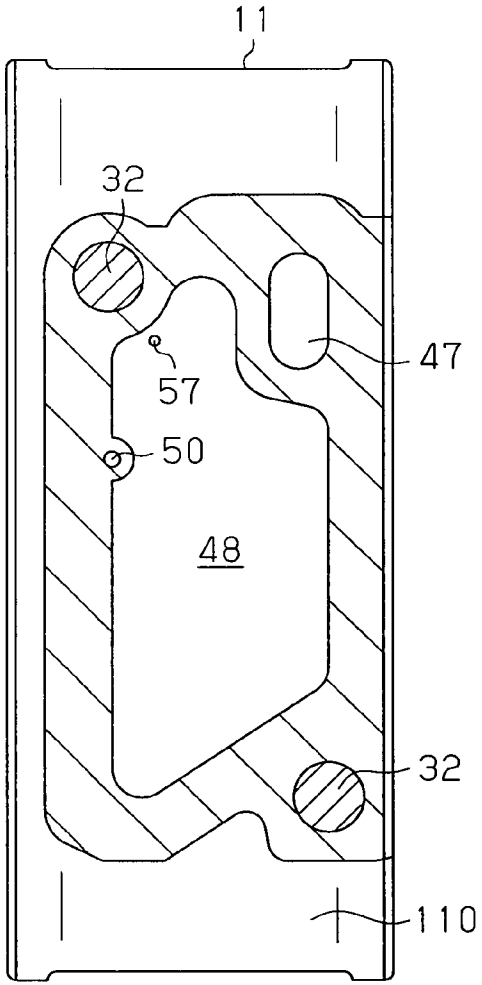
FIG. 4 is a cross-sectional view taken along line 4-4 in FIG. 2A.

The muffler chamber 33 is connected to the valve accommodation chamber 43 via a passage 47 formed in the gasket 31, the cylinder block 11, the valve plate 14, and the rear housing member 13. The pressure in the valve accommodation chamber 43 is applied to the low pressure chamber 342 via the passage 47 and the muffler chamber 33. FIG. 4 shows the passage 47 formed in the cylinder block 11, and FIG. 5 shows the passage 47 formed through the gasket 31.

As shown in FIGS. 2A and 3, an oil reservoir chamber 48 is formed within the pedestal 29. The oil reservoir chamber 48 is isolated from the muffler chamber 33 by the gasket 31. As shown in FIG. 2A, the oil reservoir chamber 48 is connected to the oil separating chamber 42 via a passage 49 formed in the cylinder block 11, the valve plate 14 and the rear housing member 13. An oil filter 63 is provided in a connection portion between the passage 49 and the oil separating chamber 42.

Figure 6:
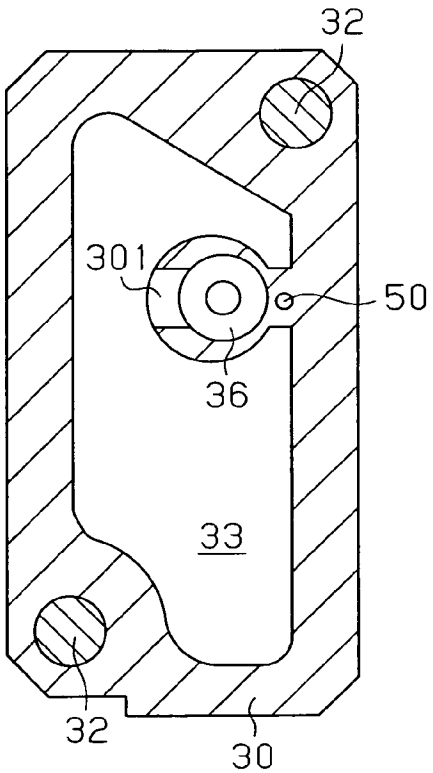
FIG. 6 is a cross-sectional view taken along line 6-6 in FIG. 2A.

The oil reservoir chamber 48 is connected to the high pressure chamber 341 via a high pressure introduction passage 50 formed in the cylinder block 11, the gasket 31, and the muffler forming member 30. An introduction port 501 of the high pressure introduction passage 50 with respect to the oil reservoir chamber 48 exists at a position close to a bottom 481 of the oil reservoir chamber 48. The pressure in the oil separating chamber 42 is applied to the high pressure chamber 341 via the passage 49, the oil reservoir chamber 48 and the high pressure introduction passage 50. FIG. 4 shows the high pressure introduction passage 50 formed in the cylinder block 11, FIG. 5 shows the high pressure introduction passage 50 formed through the gasket 31, and FIG. 6 shows the high pressure introduction passage 50 formed in the muffler forming member 30.

The refrigerant within the discharge chamber 132 shown in FIG. 1 flows out to an external refrigerant circuit 51 via the introduction passage 44, the interior of the oil separator 39, the passage 47 and the muffler chamber 33. The refrigerant flowing out to the external refrigerant circuit 51 is circulated to the suction chamber 131. On the external refrigerant circuit 51, there are provided a heat exchanger 54 for absorbing heat from the refrigerant, an expansion valve 55, and a heat exchanger 56 for transferring the surrounding heat to the refrigerant. The expansion valve 55 controls a refrigerant flow rate in correspondence to fluctuations of the gas temperature in an outlet side of the heat exchanger 56. Oil exists in a circuit comprising the variable displacement compressor 10 and the external refrigerant circuit 51, and the oil flows with the refrigerant.

The refrigerant flowing into the oil separating chamber 42 from the discharge chamber 132 via the introduction passage 44 shown in FIG. 2A swirls along the outer circumferential surface of the cylinder 41 around the cylinder 41. Accordingly, mist-like oil contained in the refrigerant is separated from the refrigerant within the oil separating chamber 42. The refrigerant swirling around the cylinder 41 flows into an internal space 412 of the cylinder 41, and the oil separated from the refrigerant flows into the oil reservoir chamber 48 via the passage 49. As shown in FIG. 3, the oil within the oil reservoir chamber 48 flows out to the control pressure chamber 121 via a return passage 57 open to a bottom portion of the oil reservoir chamber 48. The oil within the control pressure chamber 121 is used for lubricating a sliding portion within the control pressure chamber 121. The return passage 57 functions as a restriction. The oil fed to the oil reservoir chamber 48 from the oil separating chamber 42 is reserved in the oil reservoir chamber 48. The passage 49, the oil reservoir chamber 48, and the return passage 57 are connected to the oil separating chamber 42, and construct an oil introduction passage 64 introducing the oil separated from the refrigerant by the oil separator 39 to a pressure zone (the control pressure chamber 121 in the present embodiment) other than the discharge pressure zone.

There is a difference between the pressure in the oil separating chamber 42 and the pressure in the valve accommodation chamber 43. That is the pressure in the valve accommodation chamber 43 is lower than the pressure in the oil separating chamber 42. The pressure difference is generated by a decrease of the pressure in the refrigerant due to a rapid change of the moving direction of the refrigerant to the internal space 412 of the cylinder 41 after swirling the refrigerant around the cylinder 41, and by the decrease of the pressure due to a restricting function of the check valve 53. The introduction passage 44, the oil separating chamber 42, the valve accommodation chamber 43, the passage 47 and the muffler chamber 33 construct a refrigerant passage 52 of the refrigerant discharged to the outside from the interior of the housing of the variable displacement compressor 10. The refrigerant passage 52 is comparted into an upstream passage 58 comprising the introduction passage 44 and the oil separating chamber 42, and a downstream passage 59 comprising the valve accommodation chamber 43, the passage 47, and the muffler chamber 33, by the oil separator 39 and the check valve 53.

The pressure in the upstream passage 58 is applied to the high pressure chamber 341 via the passage 49, the oil reservoir chamber 48 and the high pressure introduction passage 50. The pressure in the downstream passage 59 is applied to the low pressure chamber 342 via the low pressure introduction passage 301. The pressure in the high pressure chamber 341 and the pressure in the low pressure chamber 342 act against each other via the partition body 35. The differential pressure between the pressure in the high pressure chamber 341 and the pressure in the low pressure chamber 342 acts against the spring force of the compression spring 37. The partition body 35 is arranged at a position at which the force based on the differential pressure and the spring force of the compression spring 37 are balanced. The permanent magnet 351 fixed to the partition body 35 moves away from the magnetic detector 38 in accordance with an increase of the differential pressure between the pressure in the high pressure chamber 341 and the pressure in the low pressure chamber 342.

A small clearance exists between the circumferential surface 350 of the partition body 35 and the peripheral wall surface 340 of the accommodation chamber 34. The pressure in the oil reservoir chamber 48 is applied to the high pressure chamber 341 via the high pressure introduction passage 50, and the refrigerant within the high pressure chamber 341 flows to the low pressure chamber 342 through the clearance little by little. Accordingly, the oil within the oil reservoir chamber 48 is also fed to the high pressure chamber 341, wherein the oil lubricates slidably contacting parts between the circumferential surface 350 of the partition body 35 and the peripheral wall surface 340 of the accommodation chamber 34.

If the flow rate of the refrigerant flowing through the refrigerant passage 52 is increased, the differential pressure is increased, and the partition body 35 is displaced from the high pressure chamber 341 toward the low pressure chamber 342. If the flow rate of the refrigerant flowing through the refrigerant passage 52 is decreased, the differential pressure is decreased, and the partition body 35 is displaced from the low pressure chamber 342 toward the high pressure chamber 341. The position of the partition body 35 is reflected to the magnetic flux density detected by the magnetic detector 38. The magnetic flux density detected by the magnetic detector 38 reflects the position of the partition body 35, that is, the flow rate of the refrigerant flowing through the refrigerant passage 52.

The accommodation chamber 34, the partition body 35, the compression spring 37, and the magnetic detector 38 form a differential pressure type flow rate detector 60 that obtains the pressure in the upstream passage 58 and the pressure in the downstream passage 59, thereby detecting the flow rate of the refrigerant within the refrigerant passage 52.

As shown in FIG. 1, a room temperature setting device 61 and a room temperature detector 62 are connected to the displacement control computer C1. The displacement control computer C1 controls a current supplied to the electromagnetic solenoid of the displacement control valve 26 on the basis of the magnetic flux density information obtained by the magnetic detector 38 in such a manner that the room temperature detected by the room temperature detector 62 is converged into a target room temperature set by the room temperature setting device 61. That is, the displacement control computer C1 executes a feedback control for controlling the flow rate of the refrigerant to achieve a proper value on the basis of the magnetic flux density information obtained by the magnetic detector 38.

The displacement control computer C1 transmits the torque information of the variable displacement compressor 10 to an engine control computer C2 on the basis of the magnetic flux density information obtained from the magnetic detector 38. The engine control computer C2 executes a proper control of the speed of the vehicle engine E on the basis of the torque information obtained from the displacement control computer C1.

The present embodiment in detail mentioned above has the following advantages.

(1) The partition body 35 is displaced while slidably contacting the peripheral wall surface 340 of the accommodation chamber 34 in correspondence to fluctuations of the pressure difference between the pressure in the high pressure chamber 341 and the pressure in the low pressure chamber 342. Since the oil separated from the refrigerant by the oil separator 39 is introduced into the high pressure chamber 341, it is possible to suppress the abrasion in the slidably contacting parts between the circumferential surface 350 of the partition body 35 and the peripheral wall surface 340 of the accommodation chamber 34.

(2) Since the differential pressure generated between the upstream side and the downstream side of the oil separator 39 is used for detecting the flow rate of the refrigerant, it is not necessary to provide additional means for generating differential pressure (for example, a restriction). Accordingly, since the flow resistance of the refrigerant in the refrigerant passage 52 is not increased, it is possible to suppress performance deterioration of the compressor caused by the increase of the pressure loss.

(3) A case is assumed where a restriction is provided in a section of the refrigerant passage 52 that is downstream of the check valve 53, and the detection of the refrigerant flow rate is executed by using the differential pressure between the upstream side and the downstream side of the restriction. In this case, since the differential pressure is not generated in both sides of the restriction when the check valve 53 is not open immediately after starting the variable displacement compressor 10, a response delay of the partition body 35 is generated with respect to the start of the variable displacement compressor 10, and it is impossible to detect the refrigerant flow rate immediately after starting the variable displacement compressor 10.

In the present embodiment, if the variable displacement compressor 10 is started, the differential pressure is inevitably generated between the pressure in the upstream passage 58 and the pressure in the downstream passage 59 even when the check valve 53 is closed. Accordingly, even when the check valve 53 is closed immediately after starting the variable displacement compressor 10, the differential pressure type flow rate detector 60 is operated together with the start of the variable displacement compressor 10, and it is possible to promptly detect the flow rate.

(4) In order to increase the flow rate detecting accuracy in the differential pressure type flow rate detector 60, it is preferable to increase the differential pressure between the pressure in the high pressure chamber 341 and the pressure in the low pressure chamber 342. In the structure in which both of the oil separator 39 and the check valve 53 are provided on the refrigerant passage 52, it is possible to increase the differential pressure.

(5) Since the introduction port 501 of the high pressure introduction passage 50 is provided at the position close to the bottom 481 of the oil reservoir chamber 48, the oil reserved in the oil reservoir chamber 48 tends to flow into the high pressure chamber 341 through the high pressure introduction passage 50. The structure in which the introduction port 501 is provided at the position close to the bottom 481 of the oil reservoir chamber 48 contributes to a sufficient lubrication of the slidably contacting parts between the circumferential surface 350 of the partition body 35 and the peripheral wall surface 340 of the accommodation chamber 34.

(6) The oil filter 63 provided between the oil introduction passage 64 and the oil separating chamber 42 filtrates the oil fed to the oil reservoir chamber 48. Accordingly, both of the oil fed to the control pressure chamber 121 and the oil fed to the high pressure chamber 341 are filtrated by the single oil filter 63. If the oil filter 63 is arranged on the passage 49 reaching the oil reservoir chamber 48 from the oil separating chamber 42, it is possible to filtrate both of the oil fed to the control pressure chamber 121 and the oil fed to the high pressure chamber 341, by a minimum number of oil filter 63.

(7) The oil entering into the clearance between the circumferential surface 350 of the partition body 35 and the peripheral wall surface 340 of the accommodation chamber 34 not only lubricates the circumferential surface 350 and the peripheral wall surface 340, but also achieves a damper effect of suppressing vibrations from the outside and vibrations of the partition body 35 caused by the pulsation of the compressor 10.

(8) Assuming the case where the high pressure introduction passage 50 is not provided, since the passage for releasing the refrigerant gas from the oil reservoir chamber 48 does not exist, most of the oil reservoir chamber 48 is occupied by the refrigerant gas. Accordingly, the oil separated form the gas refrigerant in the oil separating chamber 42 does not flow into the oil reservoir chamber 48. Accordingly, there may be a shortage of the oil to be supplied to the control pressure chamber 121. However, in the structure provided with the high pressure introduction passage 50, the refrigerant reserved within the oil reservoir chamber 48 flows to the muffler chamber 33 via the high pressure introduction passage 50, the high pressure chamber 341, and the clearance between the circumferential surface 350 of the partition body 35 and the peripheral wall surface 340 of the accommodation chamber 34. As a result, the oil separated in the oil separating chamber 42 flows into the oil reservoir chamber 48 without any trouble.

(9) The pressure in the muffler chamber 33 is introduced to the low pressure chamber 342 connected to the muffler chamber 33. The passage structure for connecting the low pressure chamber 342 to the muffler chamber 33 is simple, and the structure in which the muffler chamber 33 is formed as the downstream passage of the refrigerant passage 52 simplifies the passage structure for introducing the pressure in the downstream passage to the differential pressure type flow rate detector 60 provided in the muffler forming member 30.

Figure 7:
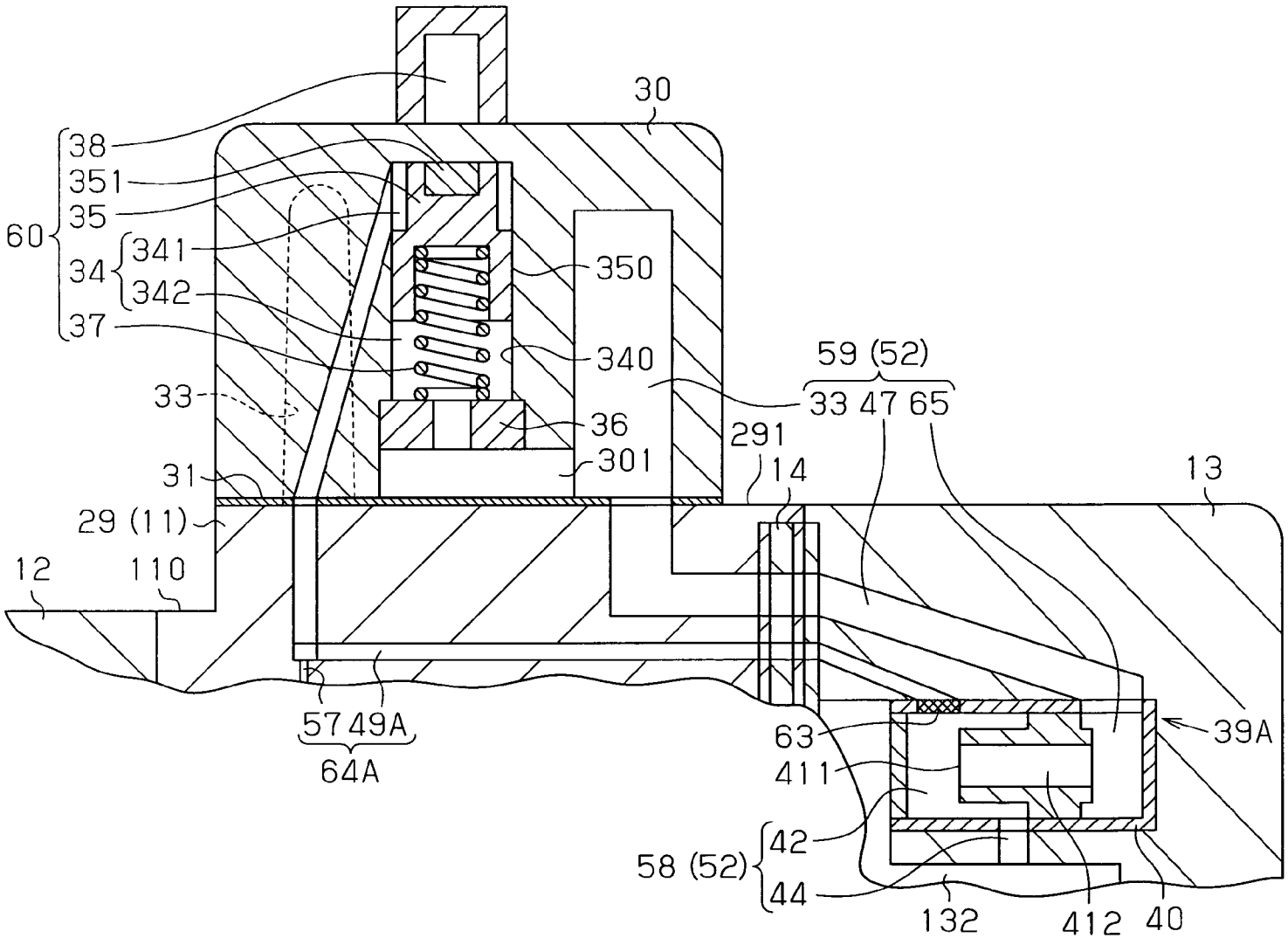
FIG. 7 is a partially cross-sectional side view of a compressor in accordance with a second embodiment of the present invention.

Next, a description will be given of a second embodiment according to the present invention with reference to FIG. 7. Some of the reference numerals used in the previous description will be used below, a description of the common structure will be omitted. Description will be given only of the modified portions.

In the present embodiment, the check valve 53 in the first embodiment is not provided. That is, an oil separator 39A in accordance with the present embodiment does not have a check valve, and the refrigerant swirling cylinder 41 defines a low pressure chamber 65 within the housing 40. The low pressure chamber 65 is connected to the passage 47. The pressure in the low pressure chamber 65 is lower than the pressure in the oil separating chamber 42, and the pressure in the low pressure chamber 65 is applied to the low pressure chamber 342. In the present embodiment, which is not provided with the check valve, the differential pressure between the pressure in the oil separating chamber 42 and the pressure in the low pressure chamber 65 becomes smaller than the differential pressure between the pressure in the oil separating chamber 42 and the pressure in the valve accommodation chamber 43 in the first embodiment.

Further, in the present embodiment, the oil reservoir chamber 48 in the first embodiment is not provided, and the high pressure introduction passage 50 and the return passage 57 are connected to a passage 49A. The return passage 57 and the passage 49A construct an oil introduction passage 64A which is connected to the oil separating chamber 42 (the upstream passage 58), and introduces the oil separated by the oil separator 39 to a pressure zone (the control pressure chamber 121 in the present embodiment) other than the discharge pressure zone. The pressure in the oil separating chamber 42 is applied to the high pressure chamber 341.

In accordance with the second embodiment, it is possible to obtain the same advantages as the advantages (1), (2) and (6) to (9) of the first embodiment mentioned above.

Figure 8:
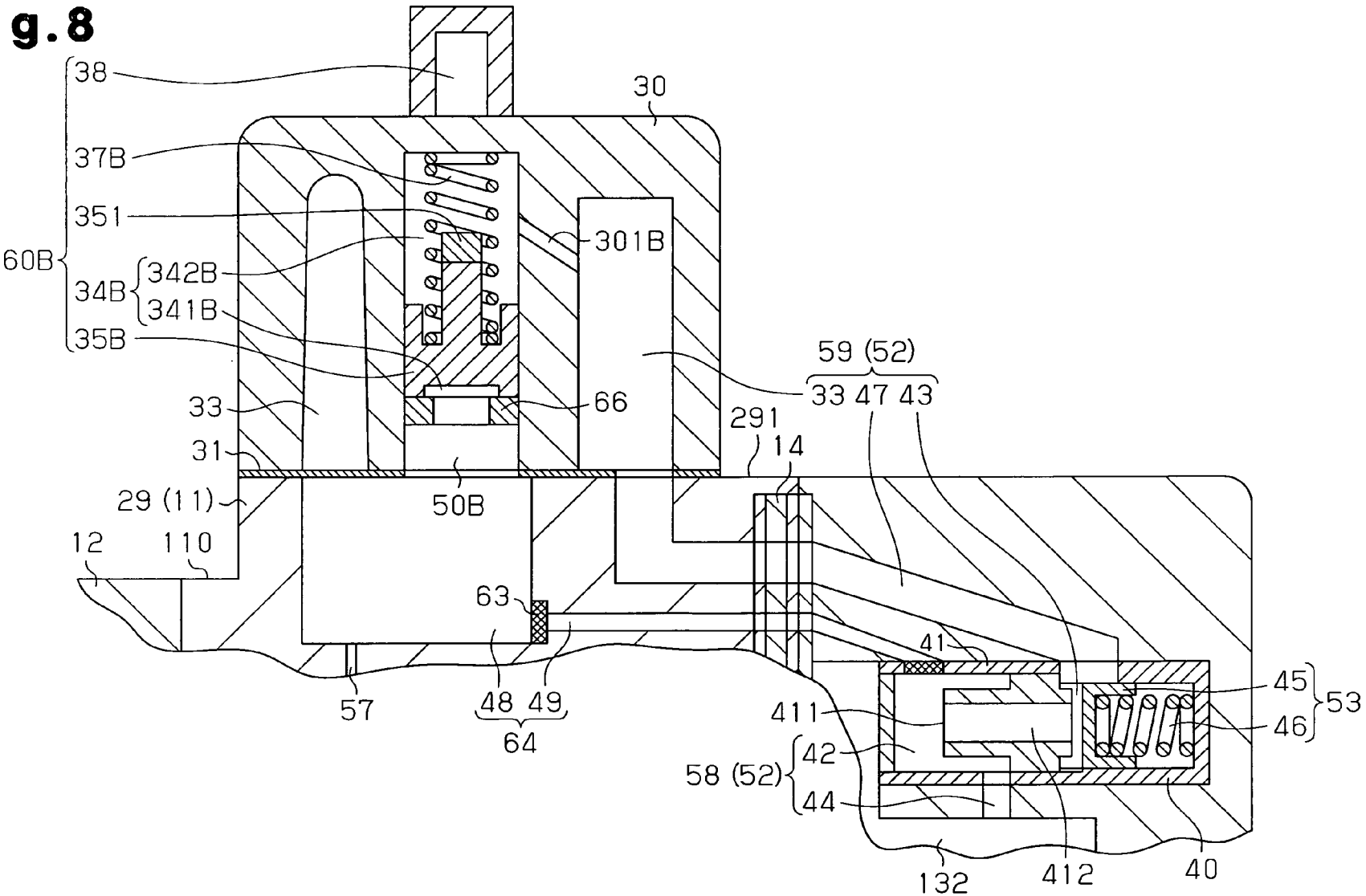
FIG. 8 is a partially cross-sectional side view of a compressor in accordance with a third embodiment of the present invention.

Next, a description will be given of a third embodiment according to the present invention with reference to FIG. 8. Some of the reference numerals used in the previous description will be used below, and a description of the common structure will be omitted. Description will be given only of the modified portions.

A partition body 35B of a differential pressure type flow rate detector 60B comparts an accommodation chamber 34B into a high pressure chamber 341B and a low pressure chamber 342B, and a compression spring 37B is accommodated in the low pressure chamber 342B. The compression spring 37B urges the partition body 35B toward a ring-shaped positioning seat portion 66 arranged in the high pressure chamber 341B. The high pressure chamber 341B is connected to the oil reservoir chamber 48 via a high pressure introduction passage 50B passing through the gasket 31. The low pressure chamber 342B is connected to the muffler chamber 33 via a low pressure introduction passage 301B formed in the muffler forming member 30. The permanent magnet 351 fixed to the partition body 35B moves closer to the magnetic detector 38 as the differential pressure between the pressure in the high pressure chamber 341B and the pressure in the low pressure chamber 342B increases. The oil filter 63 is provided between the passage 49 and the oil reservoir chamber 48.

In accordance with the third embodiment mentioned above, it is possible to obtain the same advantages as the advantages (1) to (9) of the first embodiment mentioned above.

Each of the embodiments mentioned above may be modified as follows.

The oil separated by the oil separating chamber 42 may be recirculated to a suction pressure zone.

The oil separator 39 of the type that swirls refrigerant around the refrigerant swirling cylinder 41 may be replaced by an oil separator which rapidly changes the moving direction of the refrigerant within an oil separating chamber (for example, a U-shaped passage chamber or a meander passage chamber), thereby executing the oil separation.

In the first to third embodiments mentioned above, the muffler forming member 30 is coupled to the pedestal 29 of the cylinder block 11 via the gasket 31. However, the muffler forming member 30 may be coupled to the outer circumferential surface of the front housing member 12 or the outer circumferential surface of the rear housing member 13. Alternatively, the muffler forming member 30 may be coupled to an outer circumferential surface which extends over at least two members among the cylinder block 11, the front housing member 12, and the rear housing member 13.

The structure may be made such that the oil separator is located on the external refrigerant circuit 51 reaching the heat exchanger 54 from the muffler forming member 30, and the differential pressure between both sides of the oil separator is introduced to the differential pressure type flow rate detector 60. In this case, the differential pressure type flow rate detector 60 also detects the refrigerant flow rate in the compressor 10.

The structure may be made such that a passage forming member is provided between the external refrigerant circuit 51 and the suction chamber 131, a gasket is interposed between the housing of the variable displacement compressor 10 and the passage forming member, and a differential pressure type flow rate detector is provided in the passage forming member. The differential pressure type flow rate detector in this case detects the refrigerant flow rate flowing into the suction chamber 131 from the external refrigerant circuit 51.

The present invention may be applied to a fixed displacement compressor.

What is claimed is:

1. A refrigerant flow rate detecting structure in a compressor, wherein the compressor includes:

a refrigerant passage through which the refrigerant passes, wherein the passage is comparted into an upstream passage having a high pressure and a downstream passage having a low pressure;

a differential pressure type flow rate detector that obtains the pressure in the upstream passage and the pressure in the downstream passage to detect a refrigerant flow rate within the refrigerant passage, wherein the detector is provided with an accommodation chamber, a partition body slidably accommodated within the accommodation chamber, a first pressure chamber, and a second pressure chamber, the first and second pressure chambers being separated from each other by the partition body, wherein the pressure in the upstream passage is transmitted to the first pressure chamber, and the pressure in the downstream passage is transmitted to the second pressure chamber;

a discharge pressure zone into which the compressed refrigerant gas is discharged;

an oil separator having an oil separating chamber separating the oil from the refrigerant within the upstream passage, wherein the oil separator comparts the refrigerant passage into the upstream passage and the downstream passage;

an oil introduction passage connected to the oil separating chamber, the oil introduction passage introducing the oil separated from the refrigerant by the oil separator to a pressure zone other than the discharge pressure zone; and a high pressure introduction passage introducing the pressure in the upstream passage to the first pressure chamber via the oil introduction passage.

2. The structure according to claim 1, further comprising a check valve located downstream of the oil separator.

3. The structure according to claim 2, further comprising a low pressure introduction passage introducing the pressure in the downstream passage to the second pressure chamber, wherein the low pressure introduction passage is connected to a section of the downstream passage that is downstream of the check valve.

4. The structure according to claim 1, wherein the oil introduction passage has an oil reservoir chamber, and the high pressure introduction passage is connected to the oil reservoir chamber.

5. The structure according to claim 1, wherein the oil introduction passage is provided with an oil filter filtrating both of the oil heading for the pressure zone other than the discharge pressure zone, and the oil heading for the high pressure introduction passage.

6. The structure according to claim 1, wherein the compressor is a variable displacement compressor that is provided with a control pressure chamber for controlling the displacement of the refrigerant, wherein the refrigerant in the discharge pressure zone of the compressor is supplied to the control pressure chamber via the supply passage, and the refrigerant in the control pressure chamber is discharged to a suction pressure zone via a discharge passage, so that the pressure in the control pressure chamber is adjusted, whereby the displacement of the refrigerant is controlled.

7. The structure according to claim 1, wherein the compressor includes a housing that is connected to an external refrigerant circuit via the refrigerant passage, wherein the structure includes a passage forming member coupled to an outer surface of the housing and forming a part of the refrigerant passage, and wherein the differential pressure type flow rate detector is provided in the passage forming member.

* * * * *